US007875127B2

(12) United States Patent
Porter et al.

(10) Patent No.: US 7,875,127 B2
(45) Date of Patent: Jan. 25, 2011

(54) MOVABLE SINK PARTS WASHER

(75) Inventors: Brian E. Porter, Addison, IL (US); Theodore J. Thelin, Algonquin, IL (US); Chris Oelhafen, Carpenterville, IL (US); Colin Greenidge, Thousand Oaks, CA (US); Stephen H. Kaminski, Newbury Park, CA (US)

(73) Assignee: Safety-Kleen Systems, Inc., Plano, TX (US)

( * ) Notice: Subject to any disclaimer, the term of this patent is extended or adjusted under 35 U.S.C. 154(b) by 378 days.

(21) Appl. No.: 11/767,299

(22) Filed: Jun. 22, 2007

(65) Prior Publication Data

US 2008/0314417 A1 Dec. 25, 2008

(51) Int. Cl.
*B08B 3/00* (2006.01)

(52) U.S. Cl. ..... 134/115 R; 134/58 R; 134/110; 134/34; 312/228; 312/228.1

(58) Field of Classification Search ..... 134/111, 134/110, 34, 115 R, 58 R, 112; 312/228, 312/228.1
See application file for complete search history.

(56) References Cited

U.S. PATENT DOCUMENTS

| | | | | | |
|---|---|---|---|---|---|
| 3,378,019 | A | * | 4/1968 | Riolo et al. | 134/111 |
| 3,522,814 | A | * | 8/1970 | Olson | 134/111 |
| 4,052,227 | A | * | 10/1977 | Delo et al. | 134/56 R |
| 4,226,548 | A | * | 10/1980 | Reith | 401/188 R |
| 4,462,415 | A | * | 7/1984 | Otzen | 134/111 |
| 4,817,649 | A | * | 4/1989 | Schmalz et al. | 134/58 R |
| 5,318,056 | A | * | 6/1994 | Kusz et al. | 134/95.3 |
| 5,322,078 | A | * | 6/1994 | Tuttle | 134/104.4 |
| 5,513,667 | A | | 5/1996 | Usher | |
| 5,598,861 | A | * | 2/1997 | Danowski et al. | 134/111 |
| 5,649,557 | A | | 7/1997 | Usher | |
| 5,827,374 | A | | 10/1998 | Mansur | |
| 5,950,647 | A | | 9/1999 | Usher | |
| 6,016,818 | A | | 1/2000 | Evaro et al. | |
| 6,061,818 | A | * | 5/2000 | Touba et al. | 714/739 |
| 6,068,707 | A | | 5/2000 | Magliocca | |
| 6,199,565 | B1 | | 3/2001 | Bluestone | |
| 6,306,221 | B1 | * | 10/2001 | Magliocca | 134/10 |
| 7,303,908 | B1 | * | 12/2007 | Overland | 435/289.1 |
| 7,484,515 | B1 | * | 2/2009 | Bluestone et al. | 134/108 |
| 2002/0170978 | A1 | | 11/2002 | Mohn | |

FOREIGN PATENT DOCUMENTS

| | | |
|---|---|---|
| EP | 1574262 | 9/2005 |
| FR | 2150749 | 4/1973 |
| GB | 2171384 | 8/1986 |

OTHER PUBLICATIONS

European Patent Office, European Search Report of Application No. EP 08 156 492.4, Sep. 22, 2008, Munich Germany.

* cited by examiner

*Primary Examiner*—Michael Kornakov
*Assistant Examiner*—Katelyn B Whatley
(74) *Attorney, Agent, or Firm*—Vedder Price P.C.

(57) ABSTRACT

The present disclosure is directed to a parts washer with a movable sink and a movable lid connected to a housing for facilitating replacement and maintenance of a cleaning solution reservoir. A pump is also pivotally connected to the sink to lift the pump during replacement and maintenance operations.

15 Claims, 9 Drawing Sheets

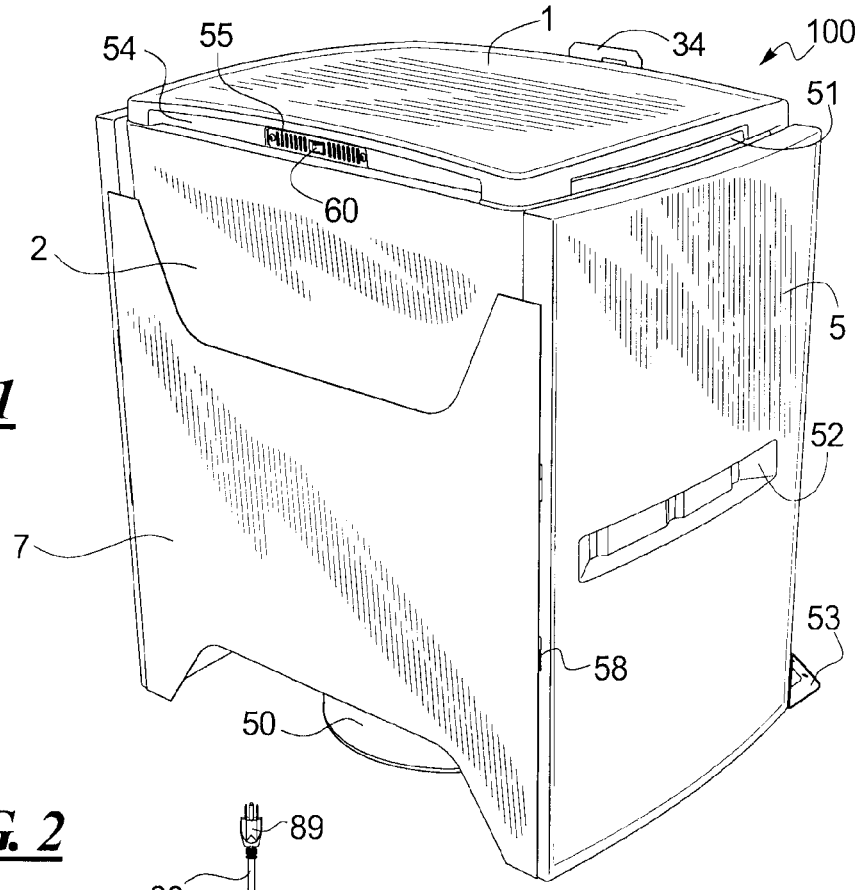
FIG. 1
FIG. 2
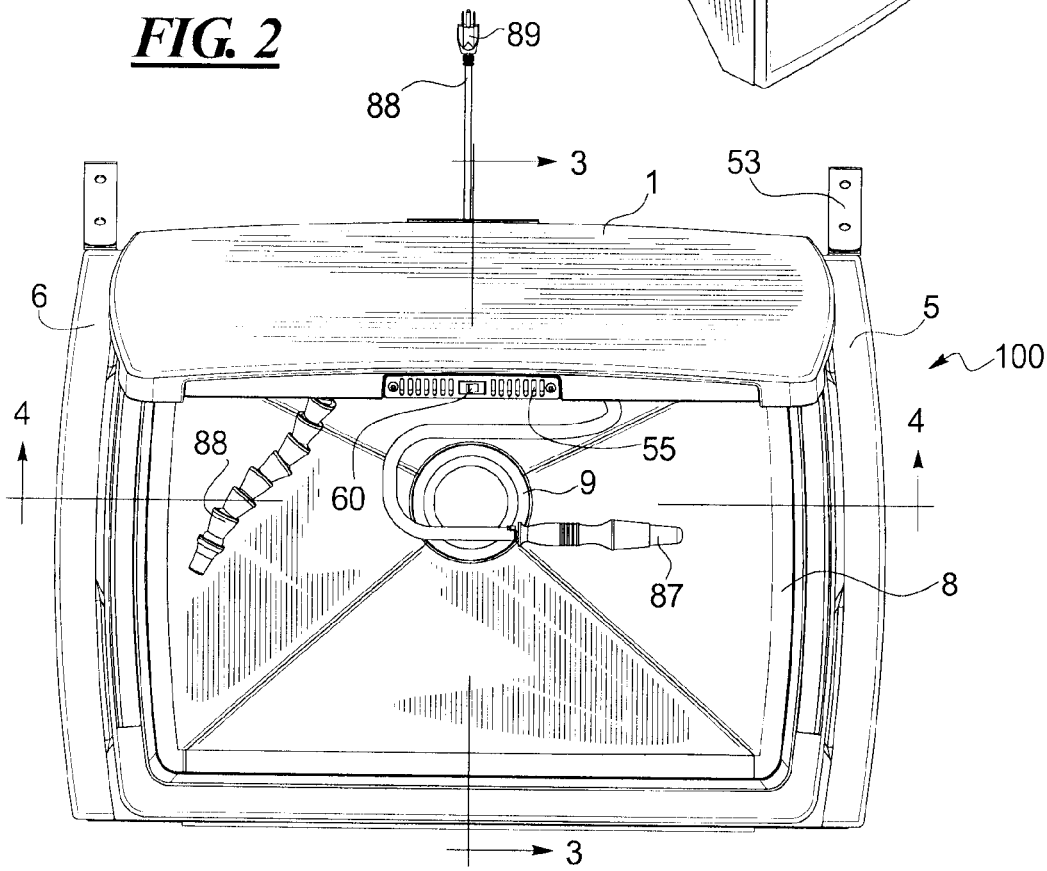

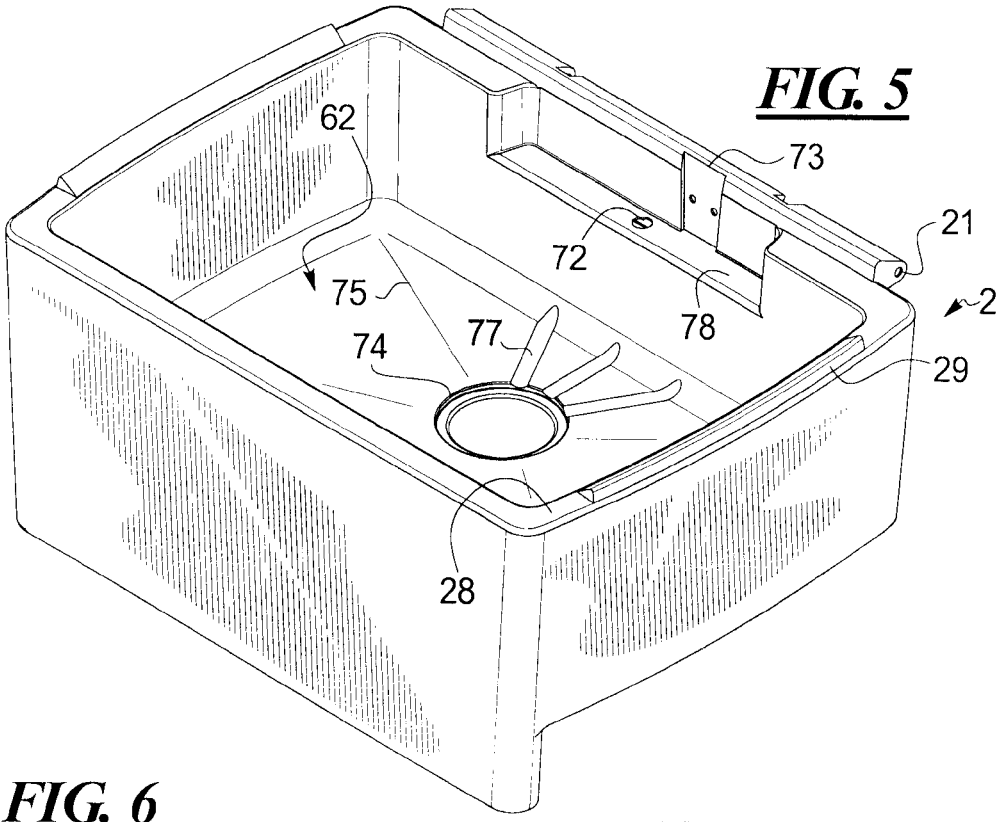
FIG. 5
FIG. 6
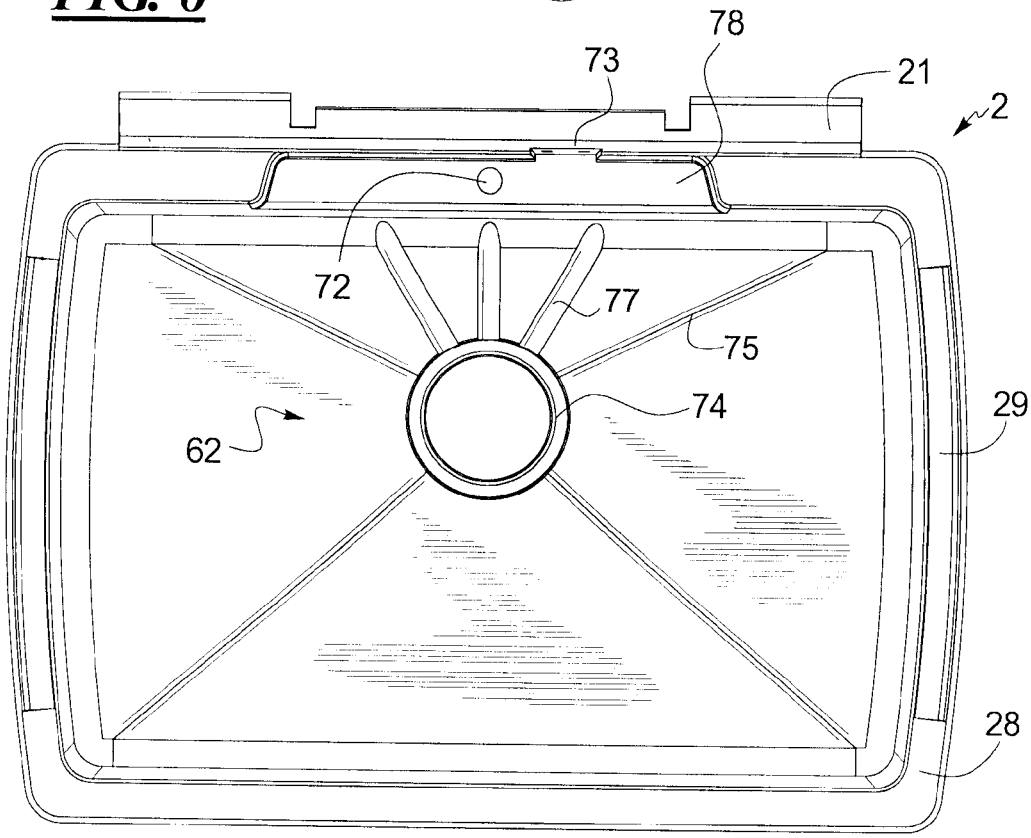

MOVABLE SINK PARTS WASHER

FIELD OF THE DISCLOSURE

The present disclosure relates generally to a movable aqueous- or solvent-based parts washer used to wash grease, oil, dirt, and other debris from mechanical parts using a cleaning solution, and more particularly, to a parts washer with a movable sink and movable lid pivotally connected to a hollow housing for facilitating access within the housing for the replacement and maintenance of a cleaning solution reservoir.

BACKGROUND

The present disclosure relates to an apparatus for washing mechanical parts using a multipurpose aqueous- or solvent-based parts washer. Mechanical parts collect dirt, abrasion residue, used grease, and other debris during normal operation. During periodic maintenance extraordinary maintenance, repairs, and scheduled upgrades, mechanics disassemble parts from a larger mechanical element, such as a car engine or other industrial equipment. Individual parts and subassemblies must be washed before they are either discarded, diagnosed, and reinstalled or before they are reconditioned for further use.

A parts washer is an apparatus that cleans parts, either individually or in groups of parts, including but not limited to machinery and machine parts. Parts washers can also clean elements such as chains, tools, and other elements susceptible to contamination from contact with greased or oiled parts. These cabinet-sized devices are an essential tool for any mechanic or worker who cleans parts in a workshop. For example, automobile mechanics place parts washers alongside tools or adjacent their work areas. The fundamental technology associated with parts washers is not unlike the technology associated with the cleaning of kitchen utensils and other food preparation accessories, the significant difference being that mechanical parts washer residue must be controlled before the effluents are released into the environment. Therefore, different cleaning solutions are often used, parts are generally washed infrequently once dirt is dried, oil-based effluents must be collected and confined, insoluble debris must be collected and filtered as sludge, and cleaning solutions are regenerated. The workshop environment in which parts washers are used also differs from location to location. Some parts washers use an aqueous cleaning solution to dissolve and remove grease, carbon, resin, tar, ink, and other debris. These parts washers use water, soap, and/or detergents, either commonly available or proprietary. Other more aggressive parts washers use hydrocarbon-based solvents or other solvents to degrease and wash parts. What is contemplated by this disclosure is a parts washer capable of using any type of cleaning solution, but more preferably, a parts washer capable of using either an aqueous-based or a solvent-based cleaning solution.

Before the arrival of parts washers, mechanics used small containers, collected a small volume of cleaning solution from a drum, and used ordinary sinks. Washing operations of the sink itself were required and a large volume of cleaning solution was wasted during each wash, since most cleaning solutions can be reused. A first generation of parts washers resemble a sink positioned over a reservoir where a cleaning solution is stored and recycled. An operator of the manual parts washer might push a pedal or take other action to activate a pump submerged in the cleaning solution reservoir and auxiliary heating element located within the reservoir might heat the cleaning solution to increase solubility of the circulating fluid, much like hot water is preferred during dishwashing operations. In a second generation of parts washers, manual washing operations were mostly been replaced with automated washing.

There are many advantages to manual parts washers over automated parts washing operations. For instance, they allow for tactile recognition of fine layers of dirt on parts having complex configurations. Manual cleaning also allows for the focus of cleaning efforts at a specific location, as well as to allow parts to be cleaned immediately. Other types of manual parts washers from the prior art include Safety-Kleen® Sink Models 16, 17, 30, 31, etc. Model 16, for example, comprises a metal sink with a pivoting lid placed on a drum that acts as the cleaning solution reservoir. These devices correspond to the first generation of parts washers.

In the 16/30, a pumping system is inserted within the drum and is functionally connected to a spray device in the sink. While highly effective over manual operations, this model can be functionally improved to enhance the overall effectiveness of parts washers. First, washing sinks are generally rectangular in shape for optimal usefulness, but these sinks are often nested on a cylindrical reservoir designed for rotational displacement ease and resistance to shock during transportation. As a result, the parts washer can become unstable if weight is placed in the corners of a rectangular sink placed atop a cylindrical reservoir. Cylindrical reservoirs, generally industrial drums, also have limited aesthetic value and often get dirty or bumped in work environments. If a reservoir is bumped, its top surface may be deformed, and a sink resting on the surface is then unstable.

Second, during the process of changing and replacing dirty cleaning solution that has been used to clean parts over a certain period of time, the sink must be removed from the reservoir and rested on a protected surface. The pump attachment connected to the bottom end of the sink is extracted from the drum and drips of cleaning solution. Parts washing also often requires the use of additional external light when they are placed in remote locations of work areas. Currently, an industrial lamp is attached to the lid at a location remote from the work area. The placement of a targeted spot lamp away from the washing area does not optimize illumination during the different washing operations.

In addition, since grease and oil exhibit under certain circumstances flammable properties that can be set aflame, fusible materials are used in the art to release holding devices of lids. The placement and orientation of fusible materials, when used in conjunction with locking mechanisms and latching mechanisms, is often troublesome. A fusible link must be in thermal proximity to a heat source but away from abrasion, shock, or work areas to optimize work performance of the overall parts washer.

Parts washers are generally stored where parts are removed or processed for convenient use. Auto repair shops, for example, are often equipped with multiple repair bays. A team of mechanics remove parts to be washed at different locations. Many mechanics prefer using only their assigned tools, though they are often less possessive of a parts washer. Immediate access to a proximate parts washer often trumps the need for an assigned washer. Confined spaces and other constraints associated with workshops warrant compact and portable devices. Parts washers must also be robust and durable under strenuous and prolonged use. Finally, industrial parts washers are designed with metal parts to be resistant to the shocks and impacts with the heavy metal parts cleaned within the sink. Metal, even when painted, can corrode if in contact with humid corrosive solutions, and once bumped, can change shape.

What is needed is a third generation of parts washer capable exhibiting all the advantages of the first generation of washers, including but not limited to low cost, use of industrial drums of multiple sizes as a reservoir, lighting, portability, and simplicity of use with novel and useful features without losing the advantages of the first generation of parts washers. What is also needed is a series of operative and functional improvements to aid operators of the parts washer during washing.

SUMMARY

The present disclosure relates generally to a movable aqueous- and solvent-based parts washer used to wash grease, oil, dirt, and other debris from mechanical parts using an cleaning solution, and more particularly, to a parts washer with a movable sink and movable lid pivotally connected to a hollow housing for facilitating access within the housing for the replacement and maintenance of a cleaning solution reservoir. The third-generation washer is made of molded reinforced polymer in a shell configuration around a tilting reservoir. A pump is also pivotally connected below the sink to retract the pump during operations to change the cleaning solution reservoir. The device includes a molded sink with basin and reinforced pan with an interface to control the release of fumes between the sink and the pivoting lid. The parts washer also includes built-in light placed in proximity of the work area on the underside of the lid for illumination during washing operations, a support frame for the sink for improved stability of the apparatus, and a latching mechanism having a low fusible link for optimal fire protection response of the thermal fusible.

BRIEF DESCRIPTION OF THE DRAWINGS

The features of the present disclosure are believed to be novel and are set forth with particularity in the appended claims. The disclosure may best be understood by reference to the following description taken in conjunction with the accompanying drawings, and the figures that employ like reference numerals identify like elements.

FIG. 1 is a front perspective view of the apparatus for washing parts with a cleaning solution reservoir, the sink in a work configuration and the lid in the down configuration according to a possible embodiment of the present disclosure.

FIG. 2 is a top view of the apparatus for washing parts as shown in FIG. 1 where the sink is in the work configuration and the lid is in the up configuration according to a possible embodiment of the present disclosure.

FIG. 5 is a perspective view of the sink without the cover plate according to a possible embodiment of the present disclosure.

FIG. 6 is a top view of the sink as shown in FIG. 5 according to a possible embodiment of the present disclosure.

DETAILED DESCRIPTION

The present invention is not limited to the particular details of the apparatus or method depicted, and other modifications and applications may be contemplated. Further changes may be made in the above-described method and device without departing from the true spirit of the scope of the invention herein involved. It is intended, therefore, that the subject matter in the above depiction should be interpreted as illustrative, not in a limiting sense.

Figure 7:
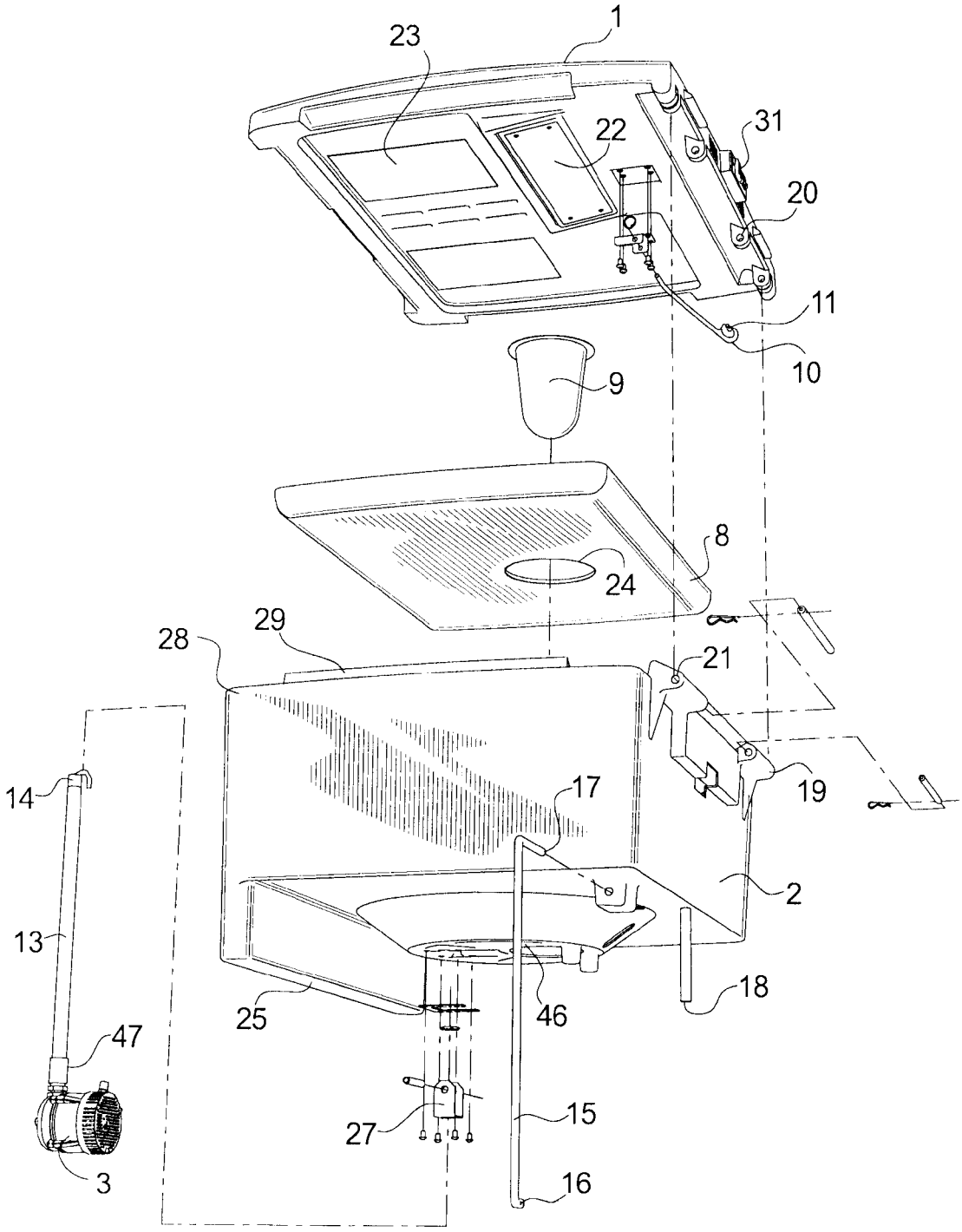
FIG. 7 is an exploded view of the apparatus for washing parts as shown in FIG. 1 without the support frame and the cleaning solution reservoir according to a possible embodiment of the present disclosure.

What is shown in FIGS. 1-10 is a new, compact, and hinged manual parts washer 100. The parts washer 100 is a compact and easy-to-clean apparatus designed for rapid access and rapid change of cleaning solution reservoirs 50 and has a plurality of improved features associated with the compact design. In one embodiment, the housing is made of several interlocking molded hollowed polymer parts assembled as a shell made of a lid 1, a sink 2, housing panels 5, 6, and a front panel 7 encasing a circulating cleaning solution 64. The lid 1 is pivotally connected above the sink 2 using tabs 20 with circular openings rested over supports 21, also with circular openings, where bars are locked into place with a pin as shown in FIG. 7. While one type of pivotal connection is shown, what is contemplated is the use of any type of known connection or interface between the lid 1 and the sink 2 to allow for the lid 1 to move between a down configuration as shown in FIG. 1 and an up configuration as shown in FIG. 2. While the term "up" is used to illustrate a configuration where washing can be performed and "down" is used to illustrate a storage configuration, these terms must not be construed to limit the up configuration to a position or location above the down configuration. What is contemplated is the use of any opening means, including but not limited to sliding rails built to move a rigid or a flexible lid into any position away from the storage configuration.

Figure 3:
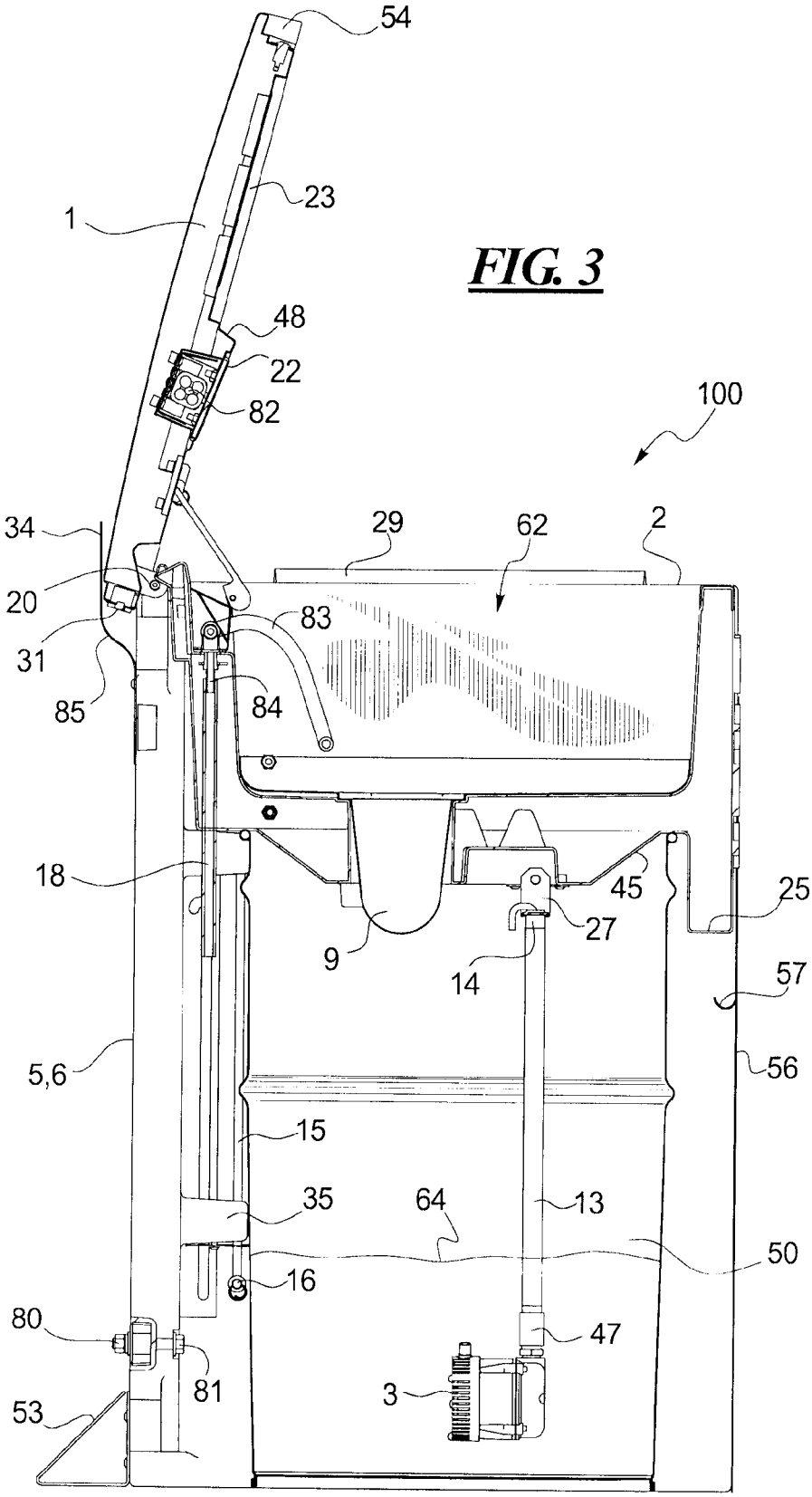
FIG. 3 is a side elevation view according to the cut line 3-3 as shown in FIG. 2 according to a possible embodiment of the present disclosure.
Figure 4:
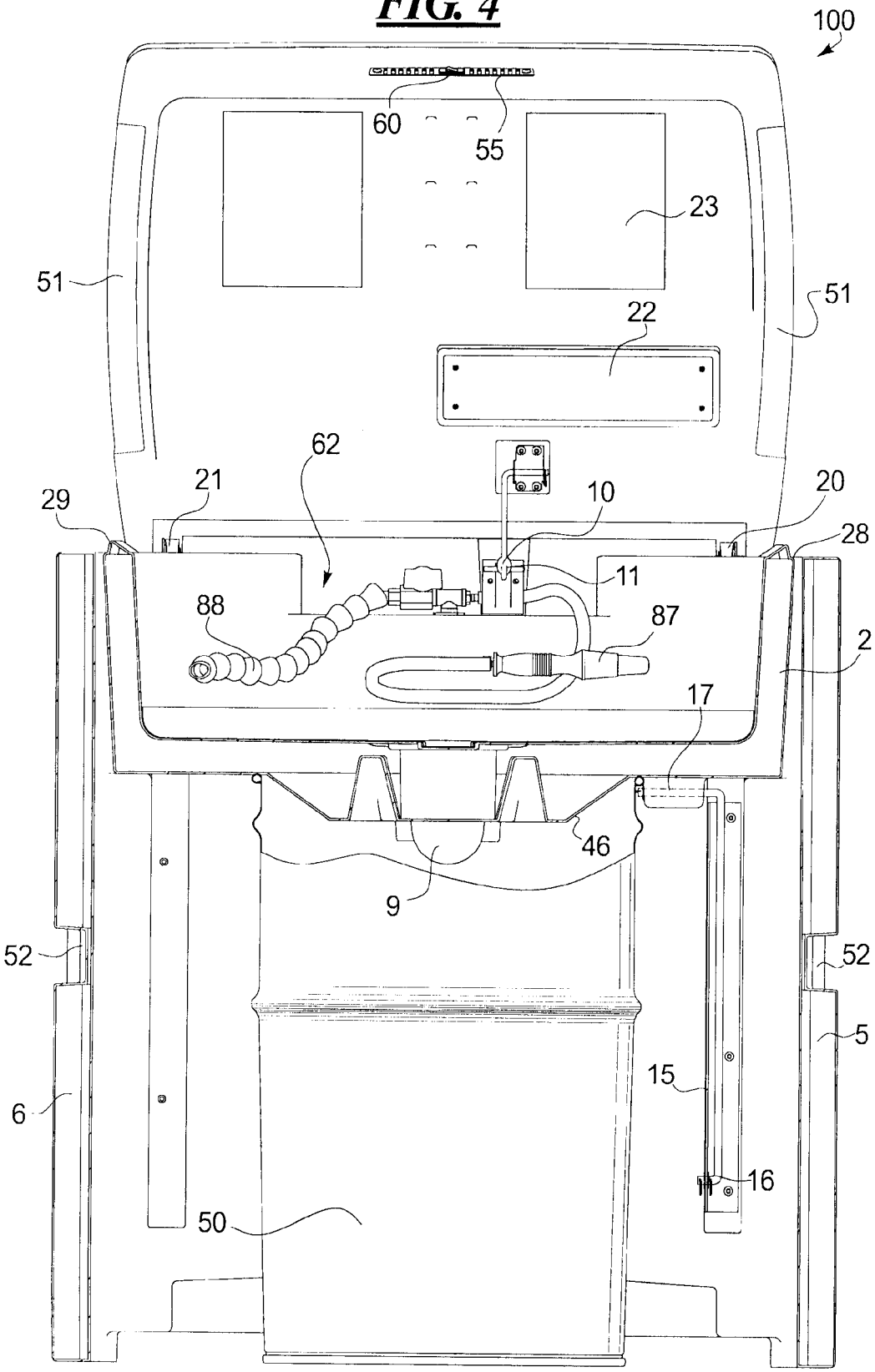
FIG. 4 is a front elevation view according to the cut line 4-4 as shown in FIG. 2 according to a possible embodiment of the present disclosure.
Figure 8:
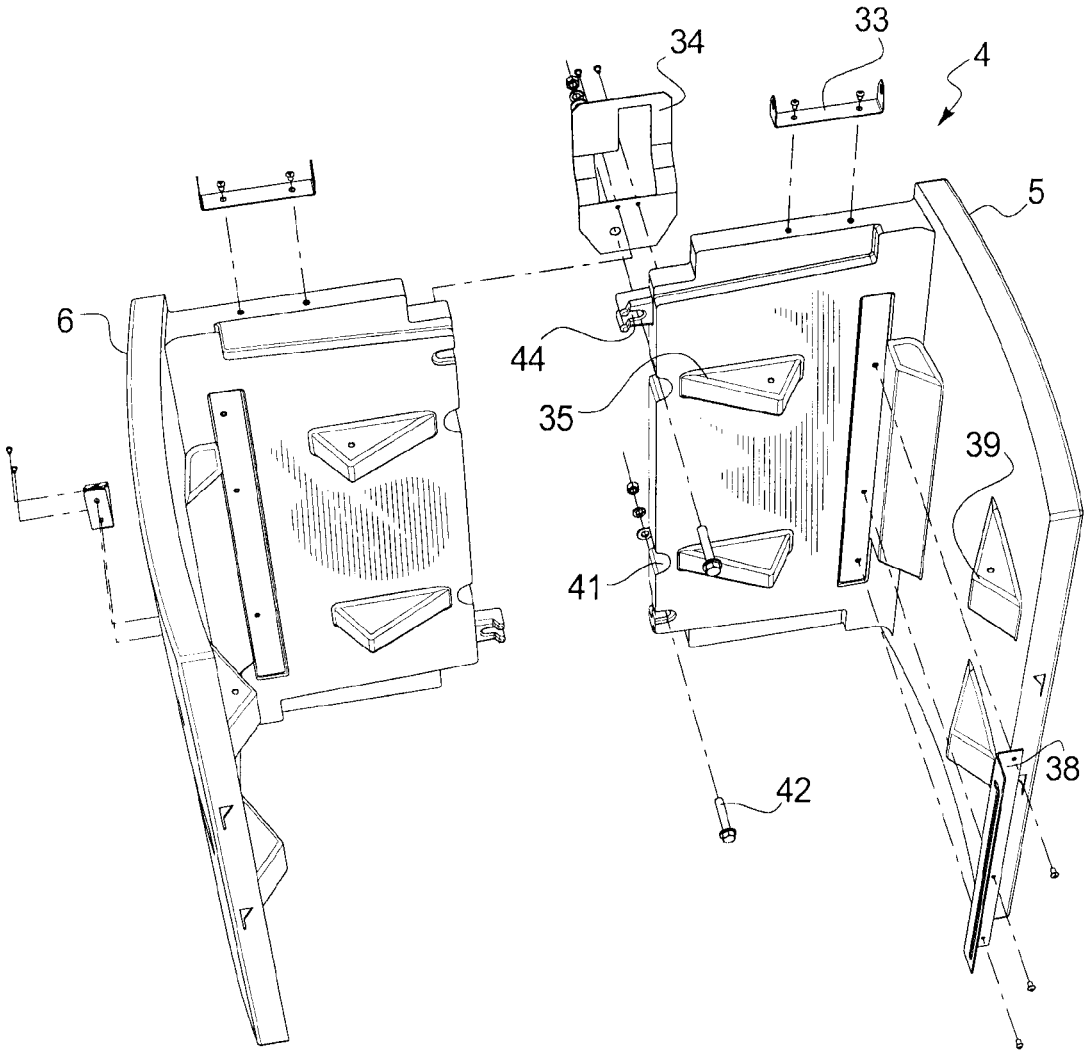
FIG. 8 is an exploded view of the two lateral panels of the support frame of the apparatus for washing parts as shown in FIG. 1 according to a possible embodiment of the present disclosure.
Figure 9:
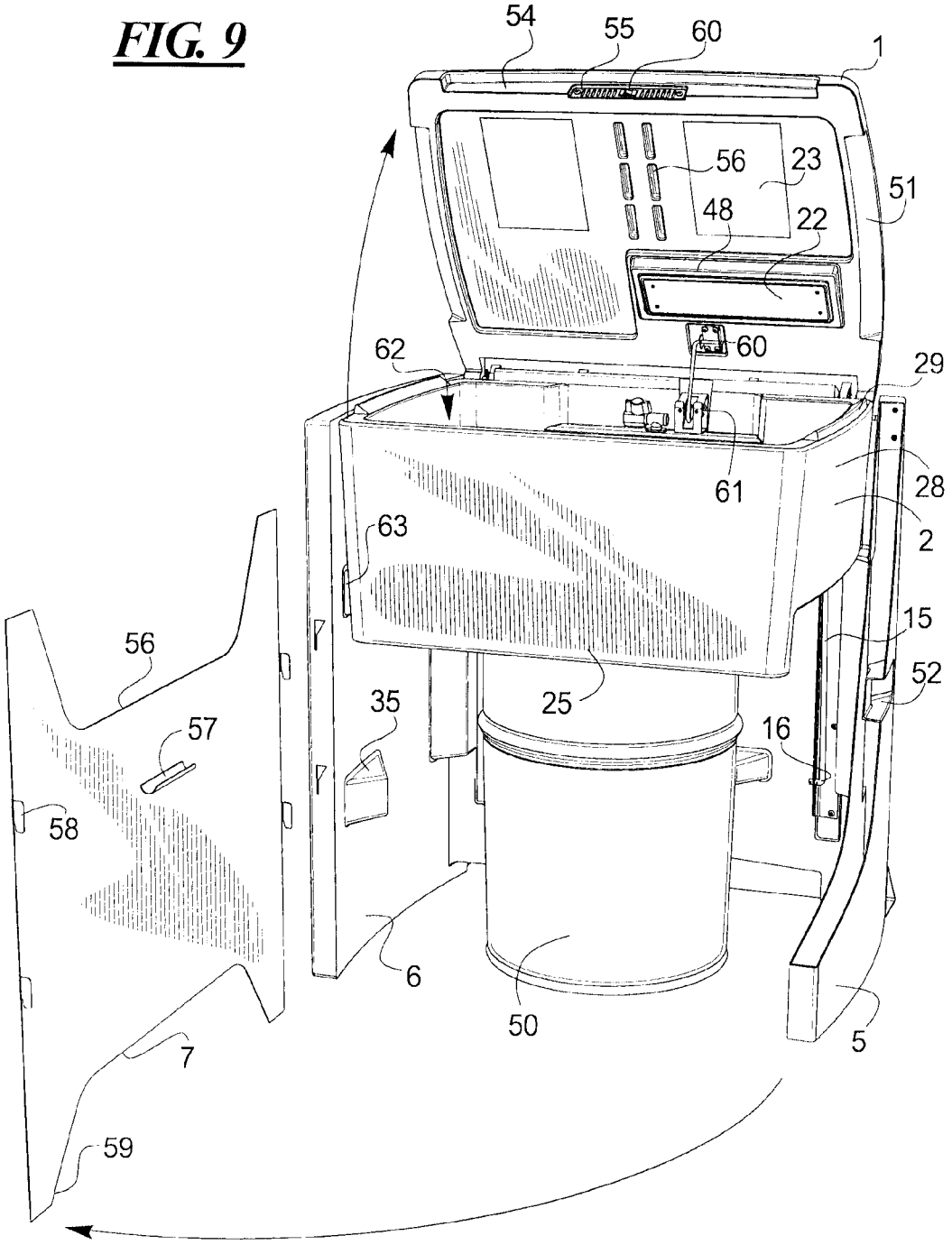
FIG. 9 is an animated front perspective view of the apparatus for washing parts as shown in FIG. 2 where the front panel is pulled away from the side panels to better illustrate the inner elements of the apparatus according to a possible embodiment of the present disclosure.
Figure 10:
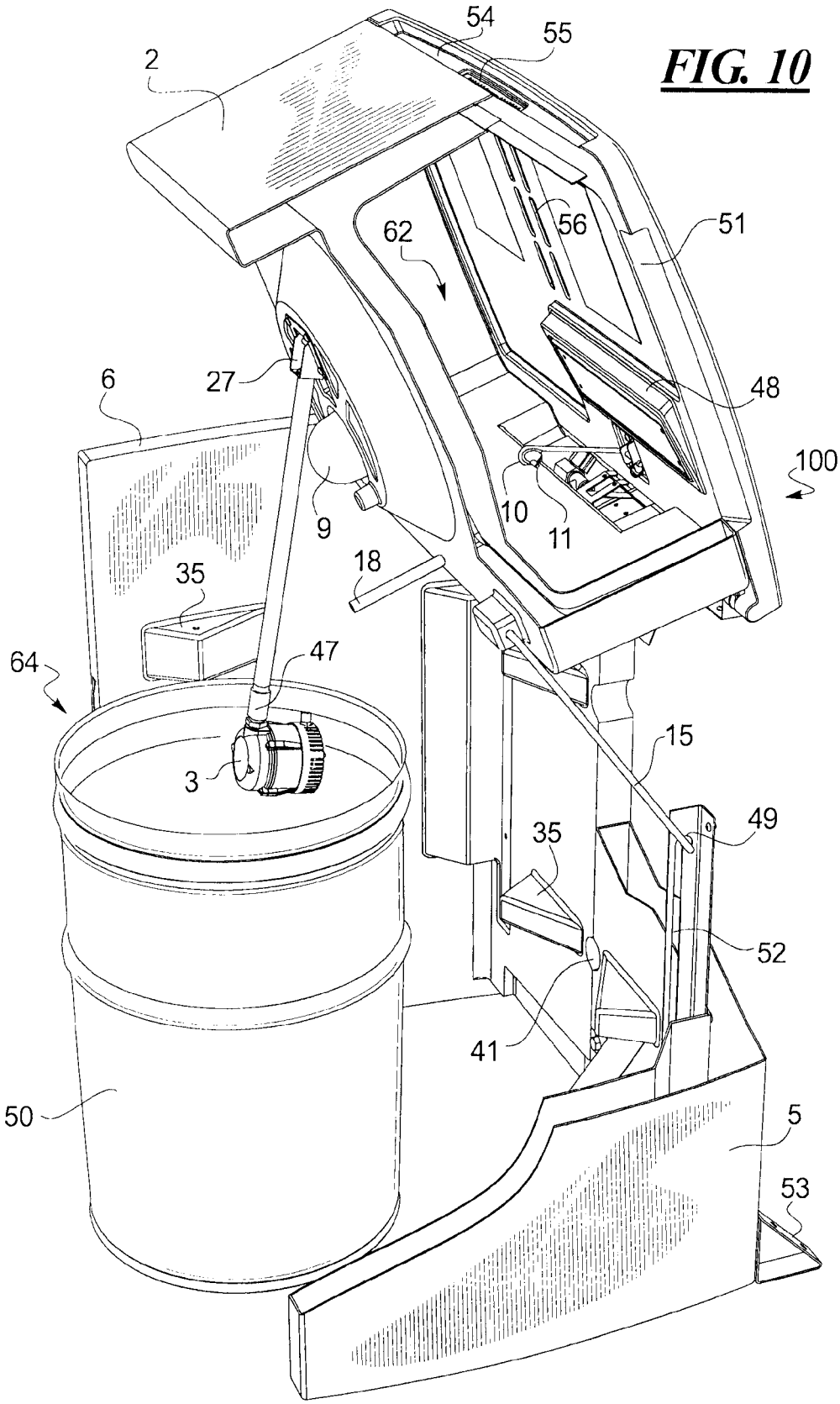
FIG. 10 is a partial view of the apparatus for washing parts with a cleaning solution reservoir, the sink in a service configuration and the lid in the down configuration according to a possible embodiment of the present disclosure.

FIG. 1 illustrates an apparatus for washing parts 100 with a support frame 4 made of two side panels 5, 6. FIG. 8 provides a detail exploded view of one possible embodiment where the support frame 4 is made of two L-shaped panels 5, 6 assembled using lock tabs 44 and a bolt 42 with locker rings (shown but not numbered) to secure the panels together. FIG. 3 illustrates how a rod 81 and a bolt 80 can also be used to secure the two L-shape panels 5, 6 together. Returning to FIG. 8, the panels 5, 6 are designed with a vertical symmetry where panel 5 is the same as panel 6 but rotated 180 degrees in a horizontal axis. Panels 5, 6 are equipped with shock placement holders 35, 39 designed to help position a cylindrical cleaning solution reservoir 50 under a sink 2 resting above the support frame 4. Back openings 41 of cylindrical shape made in one embodiment are shown to provide access from the back portion to the inside of the support frame 4. FIG. 8 also shows a metal rail 38 with a groove 81 as shown in FIG. 10 with notch 16 as shown in FIG. 9, which is attached to a section of the back wall of panel 5. FIG. 10 shows how the sink support 17 bar 15, when it slides up the groove 81, moves the notch 16 from the bottom portion of the groove 81 to a top resting notch 49 to hold the sink 2 in a service configuration. While one possible apparatus for holding the sink 2 in the service configuration is shown, what is contemplated is the use of any mechanical means, include external latches, external clamps, bars, springs, ropes, etc.

Returning to FIG. 8, the support frame 4 also includes pivotal support clamps 33 screwed into the top part of the panels 5, 6 for holding the sink 2 in place as shown in FIG. 3. What is better illustrated on FIG. 9 is how the sink 2 rests in place over the support frame 4 and the pivoting support clamps 33 and rests in the front portion on the upper surface 63 of shock placement holder 39. While the sink 2 is shown as encased within the support frame 4 on both sides, the sink 2 can also be placed on an upper end of the support frame 4 or any structural element placed thereon. The support frame 4 is also shown as having external and internal structural reinforcements in the inside corners of the L-shaped panels 5, 6, as shown in FIG. 8, or on the midsection of the external surface of the panels 5, 6, as shown in FIG. 1 as element 52. What is contemplated is the use of any type of structural reinforcement, such as but not limited to internal foam, ribs, tabs, pulverized material, that is capable of giving greater strength to the support frame 4.

The sink 2 is movably connected to the support frame such that the sink is movable between a service configuration shown in FIG. 10 and a work configuration shown in FIG. 9. What is also illustrated in FIG. 9 is a front panel 7 shown with a U-shaped upper edge 56 to display the front portion 25 of the sink 2. The front panel 7 is also shown with a U-shaped lower edge and side legs 59 and secured by an attachment means 58. The opening, as contemplated in one embodiment, provides visual access to the cleaning solution reservoir 50. An operator who does not see the cleaning solution reservoir 50 could be instructed not to open the pump 3 or to place parts within the sink 2 until a new cleaning solution reservoir 50 is secured to the underside of the sink 2. The front panel 7 is also shown with one possible attachment means 58 to secure the front panel 7 to the l-shaped panels 5, 6 as part of an enclosed housing serving as the support frame 4. In one embodiment, the cleaning solution reservoir 50 is an industrial drum of cylindrical shape. A front panel holder 57 is shown as attached inside the front panel 7. What is also contemplated is the use of a transparent front panel 7 or a front panel with a door handle, openings, vents, or any other feature associated with doors. What is also contemplated but not shown is the use of a horizontal displacement system such as wheels attached to the bottom portion of the support frame 4 of the front panel 7 to improve movement of the parts washer 100 between operations of the placement of the parts washer 100 on a removable cart (not shown). What is also contemplated is the use of a bottom portion as part of the support frame 4 where the cleaning solution reservoir 50 is placed.

FIGS. 5-6 illustrate the sink 2. The sink 2 includes a cleaning portion defined by a basin 28 having a work area 62, a drain 74, and a fluid distribution device 83 as shown in FIG. 3. In one contemplated embodiment shown in FIG. 7, a rubber or metal reinforcement pan 8 is used. The pan 8 also includes an opening 24 for allowing the flow of cleaning solution 64 from the fluid distribution device 83 down to a cleaning solution reservoir 50 disposed under the basin 28 in registration with the drain 74 when the sink 2 is disposed in the work configuration to collect and store a cleaning solution 64. A strainer 9 in the shape of a hollowed out cup with an outer edge is placed into the drain 74 and through the pan 8 when one is present within the basin 28. The pan 8 is shown having curved edges and a flat bottom, but what is contemplated is the use of any pan 8 designed to absorb shock, collect debris, protect the basin 28, or serve to lift parts placed within the cleaning portion. While a pan 8 is shown in conjunction with the basin 28 and the cleaning portion, what is contemplated is the use of any useful structure, including but not limited to racks, ledges, hooks, holders, clips, stands, or even separations to enhance different cleaning operations.

Returning to the detailed description of the sink 2 as shown in FIG. 6, ridges 77 or edges can be made in the bottom of the basin 28 to facilitate the flow of cleaning solution 64 and collect debris. These ridges 77 also prevent plugging the drain 74 with objects located in the basin 28. The sink 2 also comprises closing tabs 29 located on the external edge of the sink 2 to ensure a fitted close of the lid 1 over the sink 2. What is also contemplated is the use of racks with a draining slope also located next to the external edge of the sink 2. In one contemplated embodiment, a seal (not shown) can be placed partially or circumferentially around the outer upper edge of the basin 28 for contact with the under surface of the lid. A recess 78 made in the side of the basin 28 allows for the placement of the fluid distribution device 83. FIG. 3 shows how the fluid distribution device 83 is connected to a conduit 18 via a connector 84 connected through an opening 72 shown in FIG. 5 that is ultimately connected to the fluid outlet of the pump 3 for the circulation of cleaning solution 64 to the fluid distribution device 83. In one embodiment shown in FIG. 4, the fluid distribution device 83 is made of a brush 87 or a nozzle 88 connected to a valve for selective opening and closing of the flow in each of the two proposed outlets of cleaning solution 64 in the basin 28.

The bottom portion of the sink 2 as shown in FIG. 7 includes a plurality of features all shown in a truncated bottom circular cone 46. The cleaning solution reservoir 50 is placed in open communication with the bottom surface of the circular cone 46. The pyramid 46 includes a support 27 for holding a pump 3 having a pipe support 14 attached to a pipe 13 and a pump connector 47 rotatably connected to the sink 2. The support 27 includes a U-shaped plate, a rotation plate, and securing means, such as screws, bolts, clips, magnets, or other fasteners. FIG. 10 illustrates how, when the sink 2 is rotated, the pump 3 is also rotated in the support 27 so that the pump 3 remains in a vertical orientation but is then released from the cleaning solution reservoir 50 for easy replacement of the cleaning solution reservoir 50.

The lid 1 is also movably connected to the sink 2 such that the lid 1 is movable between a down configuration shown in FIG. 1 and an up configuration shown in FIG. 2. In one embodiment, the lid 1 is equipped with onboard switches and electronic equipment. Vent plate 55 is located on the front end of the lid 1 next to the activation switch 60. In one embodiment, the activation switch 60 includes an LED for displaying a colored light when the parts washer 100 is activated. As shown, the command switch 60 when turned to the on position turns on the pump 3 and the light 22 located on the inside surface of the lid 1. Other onboard electronics include a circuit beaker 31 shown in FIG. 7 and a power outlet (not shown) for connecting the device to a remote power network via a power cable 88 and a power plug 89 shown in FIG. 2. FIG. 3 illustrates the light 22 placed within an angled casing 48 close to the center of the inner surface of the lid 1. The light includes a lamp 82 connected to the onboard electronic equipment. The inner surface also includes labels 23 for providing instructions to an operator during operation. What is also contemplated is the use of the labels 23 to provide a service sticker area associated with servicing dates and other important dates associated with the parts washer 100. In one embodiment, the lamp 22 is a fluorescent light or a compact fluorescent lamp. In one embodiment, the lid 1 has a power outlet 31 and includes a power cord 88 with a plug 89 and a power distribution assembly for energizing the pump 3 and the fluorescent lamp 22.

The lid 1 also includes a fusible link 10 rotatably connected 60 to the inside surface of the lid 1 and clipped in a fusible link bracket 61 inserted in an opening 73 for fixation shown in FIG. 5. The fusible link 10 includes a steel rod 11 housing a piece of fusible material holding a perpendicular rod. When the lid 1 is opened, the fusible link 10 rotates 60 sufficiently for the perpendicular rod to be inserted into the fusible link bracket 61 shown in FIG. 9 for holding the lid 1. The fusible link 10 is designed with a thermal capacity to allow for the fusible material to melt and allow the fusible link bracket 61 to release the fusible link 10 if exposed to a sufficiently large quantity of flames. The calibration of fusible material within a fusible link is conducted according to known principles in the art. In one alternate embodiment, the light 22 is cut when the lid 1 is in the down configuration, which can be achieved by a plurality of known methods, including but not limited to using a position sensor or an angular detector in the pivot of the lid 1 or by adding an electrical contact between the lid 1 and part of the sink 2. What is also contemplated is the use of an emergency cut-off sensor associated with the angular position of the sink 2 over the cleaning solution reservoir 50. Again, a plurality of different methods and sensors can be employed to cut off the power to the pump 3 and the light 22 if the sink 2 is moved or lifted more than a fixed position above the work configuration. In one other embodiment, a filter based bag is used within the cleaning solution reservoir 50 made of a porous material capable of collecting sludge, grease and other particles in the cleaning solution 64.

The lid 1 also includes lateral relief 51 for lifting the lid 1 to the up position and a second front relief 54 for the placement and protection of the activation switch 60. The lid 1 also includes other vents 56, shapes, or openings designed to enhance the operability of the lid 1. While one series of lateral reliefs 51, 54 is shown and one possible configuration where the light 22 is placed, what is contemplated is the placement of these and other features on the lid 1 to offer optimal configuration. The lid can be made to rest on a lid stand 34 with a bend 85 as shown in FIG. 3.

Figure 11:
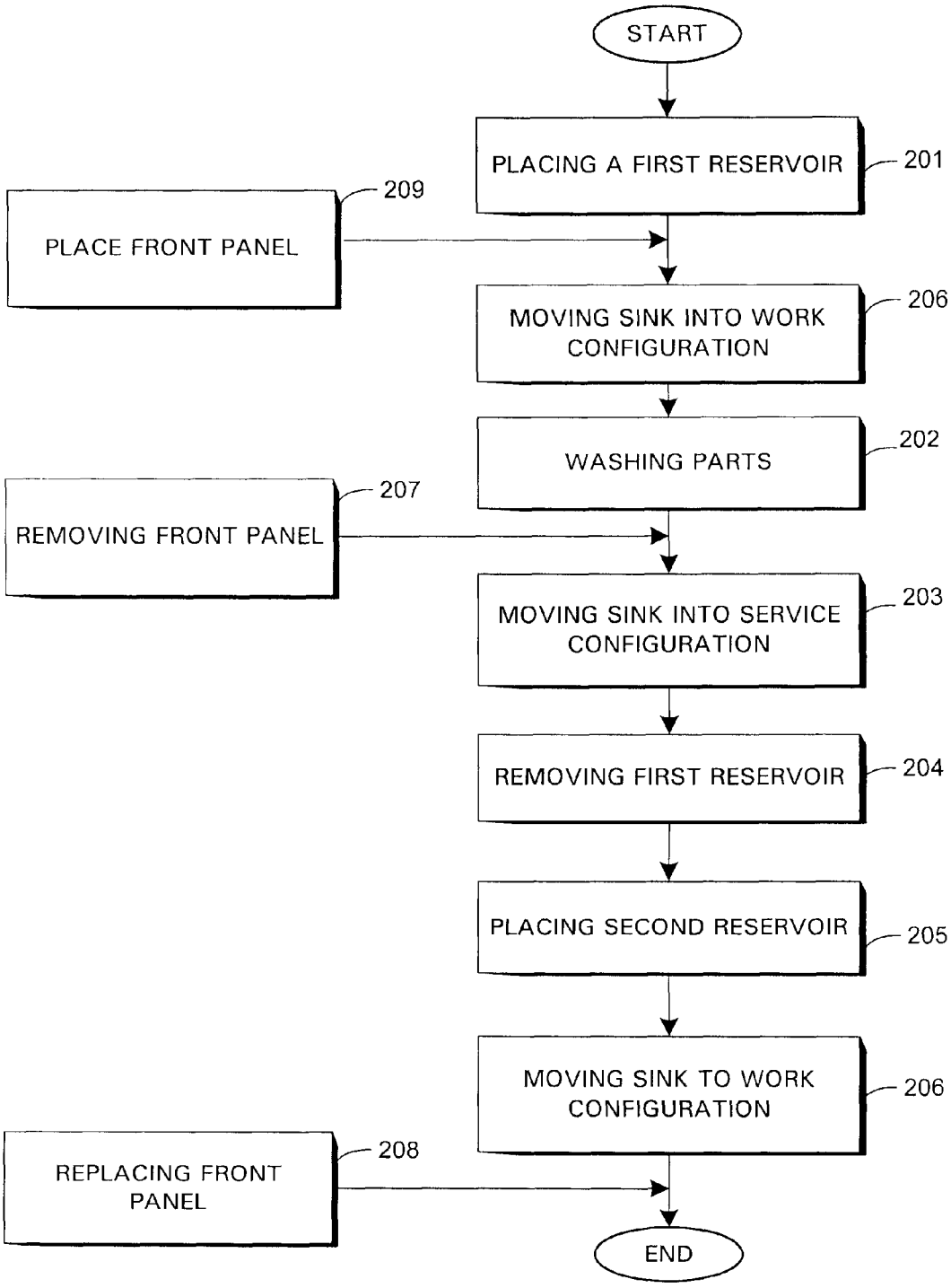
FIG. 11 is a functional diagram of the method for regenerating a cleaning solution of an apparatus for washing parts according to a first embodiment of the present disclosure.

As shown in FIG. 1, the apparatus for washing parts 100 can also include a stability bracket 53 to stabilize the apparatus on the ground. In another embodiment illustrated by FIG. 11, what is also contemplated is a method for changing a cleaning solution of an apparatus for washing parts 100 by an operator (not shown). The method includes the successive steps of placing a first cleaning solution reservoir 201 containing a new cleaning solution 64 in registration with the drain 74 of the parts washer 100, moving the sink 2 into the work configuration 206, washing parts 202 using the apparatus 100 with the sink 2 in the work configuration as shown in FIG. 1 until the cleaning solution 64 becomes dirty via suspended particles, solid particles, or a loss of degreasing capacity after saturation of oil in the cleaning solution 64. In a next step, the sink 2 is moved 203 in the service configuration as illustrated in FIG. 9 by the arrow. The first cleaning solution reservoir 50 containing the dirty cleaning solution is then removed 204 and replaced 205 by a second cleaning solution reservoir 50 containing a second cleaning solution 64. Finally, the sink 2 is moved back 206 into the work configuration as shown in FIG. 1. In an additional step of the method, the front panel 7 is placed 209 before parts are washed 202, the front panel 7 is removed 207 before the sink is moved into the service configuration 203, and the front panel 7 is replaced only after 208 moving the sink into the work configuration 206. What is also contemplated is the use of different sizes of cleaning solution reservoirs 50 adapted to the different sizes of industrial drums found in the marketplace.

It is understood that the preceding description is merely a detailed description of some examples and embodiments and methods of use of the present invention and that numerous changes to the disclosed embodiments and methods of use can be made in accordance with the disclosure herein without departing from the true spirit or scope of the invention. The preceding description, therefore, is not meant to limit the scope of the invention but to provide sufficient disclosure to one of ordinary skill in the art to practice the invention without undue burden.

What is claimed is:

1. An apparatus for washing parts comprising:

a freestanding support frame including opposed side portions and a back portion defined between the opposed side portions;

a sink pivotally connected to the back portion of the support frame on a pivot axis such that the sink is pivotable between a service configuration and a work configuration, defined when the sink is supported by the pivotal connection on the back portion of the support frame and a holder disposed on the opposed side portions, the sink including a cleaning portion defined by a basin having a work area, a drain, and a fluid distribution device;

a cleaning solution reservoir disposed under the basin aligned in registration with the drain when the sink is disposed in the work configuration to collect and store a cleaning solution;

a pump in fluid communication with the fluid distribution device to circulate the cleaning solution from the cleaning solution reservoir to the basin through the fluid distribution device and back to the cleaning solution reservoir through the drain, the pump including an inflexible pipe rigidly affixed to the pump and extending toward the sink; and a lid pivotally connected to the back portion of the support frame on the pivot axis in common with the sink such that the lid is movable between a down configuration and an up configuration, wherein the pipe is pivotally connected to the sink at a location disposed between the drain and a front portion of the sink, such that the pipe is disposed generally normal to the sink when the sink is disposed in the work configuration and the pipe pivots relative to the sink as the sink is pivoted from the work configuration to the service configuration; and wherein the service configuration is defined when the sink is pivoted to a position so that the pipe is disposed at an acute angle to the sink, the pump disposed at a distal end of the pipe is removed from and disposed above the cleaning solution reservoir and a sink support secures the sink in said position so that there is no interference between the pump and the cleaning solution reservoir when the cleaning solution reservoir is replaced.

2. The apparatus for washing parts of claim 1, wherein the support frame and the sink are made of a hollowed molded polymer shell.

3. The apparatus for washing parts of claim 2, wherein the polymer shell is made using a rotational molding process or blow molding process.

4. The apparatus for washing parts of claim 2, wherein the lid further comprises a light.

5. The apparatus for washing parts of claim 4, wherein the light is a fluorescent light.

6. The apparatus for washing parts of claim 1, wherein the sink further comprises a holder and the lid comprises an attachment bar with opposite ends where one end includes a fusible link inserted in the holder.

7. The apparatus for washing parts of claim 1, wherein the cleaning solution reservoir is an industrial drum of cylindrical shape.

8. The apparatus for washing parts of claim 1, wherein the support frame comprises two side panels and a front panel for access to the cleaning solution reservoir.

9. The apparatus for washing parts of claim 2, wherein the lid further comprises a power cord and a power distribution assembly for energizing the pump and a fluorescent light.

10. The apparatus for washing parts of claim 9, wherein the power distribution assembly includes a circuit breaker and a power switch.

11. The apparatus for washing parts of claim 8, wherein the two side panels include reinforcement ridges.

12. The apparatus for washing parts of claim 8, further comprising a lid stand.

13. The apparatus for washing parts of claim 1, wherein the sink further comprises a reinforcement pan at the bottom of the basin.

14. The apparatus for washing parts of claim 13, wherein the reinforcement pan is made of metal.

15. The apparatus for washing parts of claim 13, wherein the reinforcement pan is made of thick rubber.

* * * * *